US007429101B2

(12) United States Patent
Petersen et al.

(10) Patent No.: US 7,429,101 B2
(45) Date of Patent: Sep. 30, 2008

(54) INK SUPPLY WITH INK/AIR SEPARATOR ASSEMBLY THAT IS ISOLATED FROM INK UNTIL TIME OF USE

(75) Inventors: Daniel W. Petersen, Philomath, OR (US); David Olsen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 410 days.

(21) Appl. No.: 11/111,782

(22) Filed: Apr. 22, 2005

(65) Prior Publication Data

US 2006/0238583 A1 Oct. 26, 2006

(51) Int. Cl.
*B41J 2/175* (2006.01)

(52) U.S. Cl. ..... 347/85; 347/86

(58) Field of Classification Search ..... 347/85, 347/86, 87; 141/2, 18
See application file for complete search history.

(56) References Cited

U.S. PATENT DOCUMENTS

| | | | | |
|---|---|---|---|---|
| 5,754,207 | A | 5/1998 | Gragg et al. | |
| 6,010,210 | A | 1/2000 | Wilson et al. | |
| 6,017,118 | A | 1/2000 | Gasvoda et al. | |
| 6,264,316 | B1 | 7/2001 | Chino | |
| 6,312,115 | B1 * | 11/2001 | Hara et al. | 347/86 |
| 6,318,850 | B1 * | 11/2001 | Childers et al. | 347/85 |
| 6,386,675 | B2 | 5/2002 | Wislon et al. | |
| 6,585,359 | B1 | 7/2003 | Gasvoda et al. | |
| 6,637,872 | B2 * | 10/2003 | Ara et al. | 347/85 |
| 7,004,575 | B2 * | 2/2006 | Inoue et al. | 347/86 |
| 2004/0196342 | A1 | 10/2004 | Hara et al. | |

FOREIGN PATENT DOCUMENTS

| | | |
|---|---|---|
| EP | 0631875 | 1/1995 |
| EP | 1142719 | 10/2001 |
| EP | 1464502 | 10/2004 |
| JP | 2004209896 A * | 7/2004 |

OTHER PUBLICATIONS

International Search Report for Application No. PCT/US2006/012922. Report issued Aug. 30, 2006.

* cited by examiner

*Primary Examiner*—Anh T. N. Vo

(57) ABSTRACT

An ink container has a first chamber configured to contain ink, a second chamber configured to enclose an ink-air separating membrane consisting of a wet side portion and a dry side portion, and a structure configured to connect the first and second chambers. A sealing arrangement which is associated with the structure and which keeps the first and second chambers fluidly isolated from each other until the ink container is disposed on a printer ink supply station and ink can be supplied from the first chamber to the printer.

16 Claims, 8 Drawing Sheets

INK SUPPLY WITH INK/AIR SEPARATOR ASSEMBLY THAT IS ISOLATED FROM INK UNTIL TIME OF USE

BACKGROUND

Original ink-jet printers were developed with an ink supply and print head combined into one replaceable unit. This was a good solution for ease of replacement when the ink was completely consumed or the print head developed problems firing properly over time due to various wear-out mechanisms. Any of these problems would result in poor print quality or no printing at all.

As the reliability of the print heads increased to the point at which they could outlive the ink supply portion, printers could be designed with long-lived, permanently installed print heads and replaceable ink supplies. This allowed reduced manufacturing and operating costs as well as improved operating convenience for the printing system. However, due to several physical mechanisms (e.g. air permeability of materials, air ingestion through the nozzles and other components) longer lived print heads have problems with air accumulation over time and usage. Sufficient air may accumulate in areas of the printing system to cause poor print quality or prevent ink from flowing and being printed altogether.

BRIEF DESCRIPTION OF THE DRAWINGS

The various features and advantages of the exemplary embodiments of the invention will become more clearly appreciated as a description of the exemplary embodiments is given with reference to the drawings wherein:

FIGS. 5 and 6A-6C are views which show a second embodiment wherein FIGS. 6 and 6A are sectioned perspective views showing respectively shipping and printer mounted conditions of the second exemplary embodiment of the invention, and wherein FIGS. 6B and 6C are side and end views of spear element used in this embodiment.

DETAILED DESCRIPTION

Figure 1:
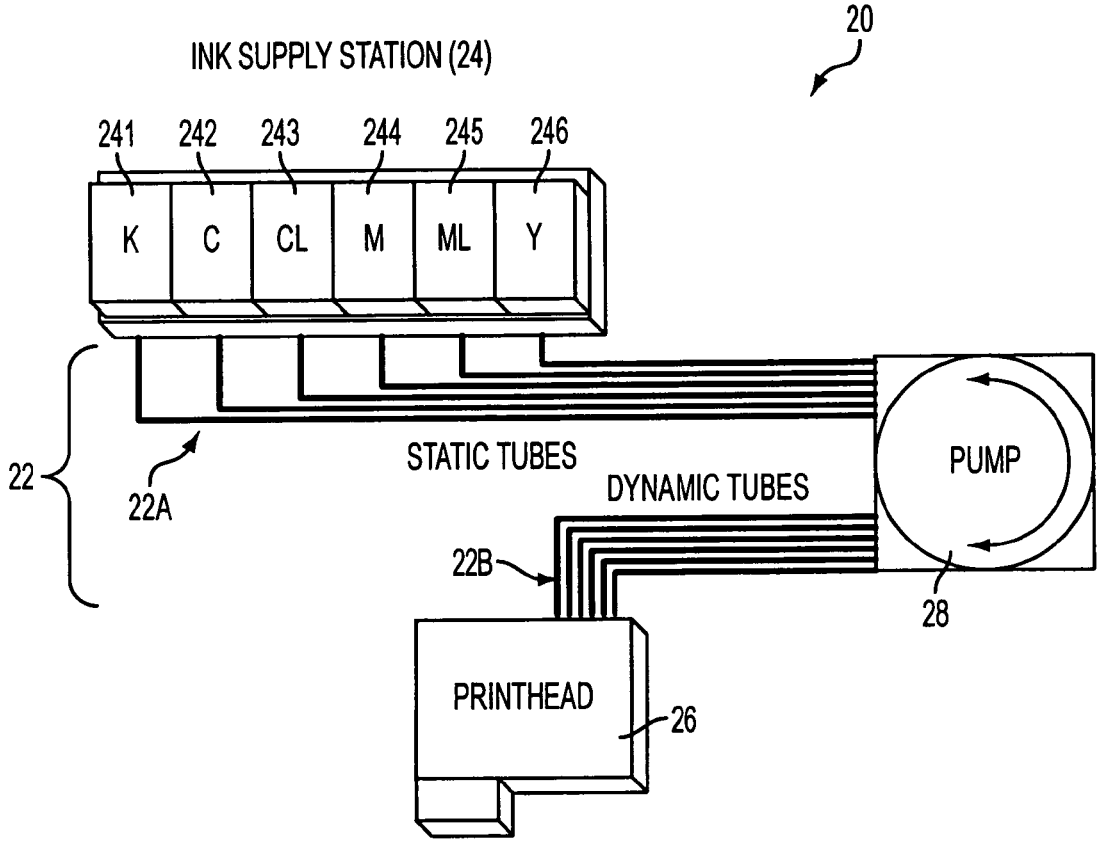
FIG. 1 is a schematic view of a ink transport system configured to move ink from the ink supply station to the printhead and to which certain exemplary embodiments of the invention are applicable.

Printer systems have been developed to manage this air accumulation in various ways often by allowing for the accumulation of air in innocuous locations within the printing system or by purging the accumulated air from the printing system altogether.

One way to purge this accumulated air is to move it from the print head back to the ink container where it can be vented back to atmosphere usually with the help of a pump. Pumping air in this manner usually entails pumping ink at the same as air time which can generate an air/ink froth which is pumped back into the ink container.

An ink/air separator utilizing a microporous membrane (hereinafter "membrane") may be installed in the ink container to separate ink and air from the ink/air froth which is generated when ink is pumped back and forth between the ink container and a ink supply station. The microporous property of the membrane prevents ink from flowing through it while allowing air to pass back and forth. This retains the ink within the ink container while allowing air to be vented out of the ink container to the atmosphere. The subject invention pertains to a method of venting this air from the ink container while preventing loss of ink from the ink container using a microporous membrane with particular emphasis on protecting the membrane from ink exposure and damage until the ink container is installed in the printer ink supply station.

However, in situations wherein the ink and membrane are allowed to remain in constant contact, a drawback tends to be encountered wherein mechanical shock and/or pressure excursions, which tend to be encountered most frequently when shipping the ink supplies from one place to another, can drive ink into the membrane and its pores. This compromises the non-wetting characteristics of the membrane; reduces the air-flow performance through the membrane at given pressure differentials; and in the extreme, can tear the membrane allowing ink to leak from the ink container.

These factors can reduce or eliminate the ability of the membrane to function as an ink/air separator. Thus, ink supplies utilizing membrane-style ink/air separators in which the ink and air are in constant contact, are prone to degradation/damage of the membrane during shipment.

Since the in-printer environment is much less harsh on the membrane as compared with the shipping environment, isolation of the membrane from ink until time of installation in the printer greatly reduces the chances of shipping-induced performance degradation. In the embodiments of the invention, this is accomplished by the use of separate chambers within the ink container and an arrangement which isolates the membrane from ink during shipping and which then allows the chambers to communicate upon installation in the printer.

This temporary isolation of ink chamber and membrane chamber may be accomplished via an elastomeric seal, staked film, or other means. Installation of the ink container in the printer ink supply station causes a breach of the seal/film allowing communication between ink and membrane chambers. A feature (e.g. side-broached or grooved needle) in the printer ink supply station at the ink container interface, is, in some embodiments, used to breach the seal/film and allow a flow path between the ink and membrane chambers at the time of installation.

Ink delivery system 20 shown in FIG. 1, includes an ink transport system 22 which is configured to move ink from the ink-supply station 24 to a printhead 26. In some embodiments, the ink transport system 22 may be a bi-directional transport system capable of moving ink from the ink-supply station 24 to the printhead 26 and vice versa. An ink transport system 22 of this type may include one or more transport paths for each color of ink. In the illustrated embodiment, the ink transport system 22 includes tubes that link each ink container, i.e. 241, 242, 243, 244, 245 and 246 of the ink-supply station 24, to the printhead.

In the illustrated embodiment, there are six such tubes that fluidically couple the ink containers 241, 242, 243, 244, 245 and 246 to the printhead. Each tube may be constructed with sufficient length and flexibility to allow the printhead 26 to scan across a printing zone. Furthermore, the tubes may be at least partially chemically inert relative to the ink that the tube transports.

The ink transport system 22 may include one or more mechanisms configured to effectuate the transport of ink through an ink transport path. Such a mechanism may work to establish a pressure differential that encourages the movement of ink. In the illustrated embodiment, fluid transport system includes a pump 28 configured to effectuate the transport of ink through each tube. Such a pump 28 may be configured as a bidirectional pump that is configured to move ink in different directions through a corresponding ink transport path.

An ink transport system 22 may include two or more portions. For example, a first portion 22A wherein each tube includes a static portion linking an ink container to the pump 28 and a dynamic portion 22B linking the pump 28 to the printhead 22.

Figure 2:
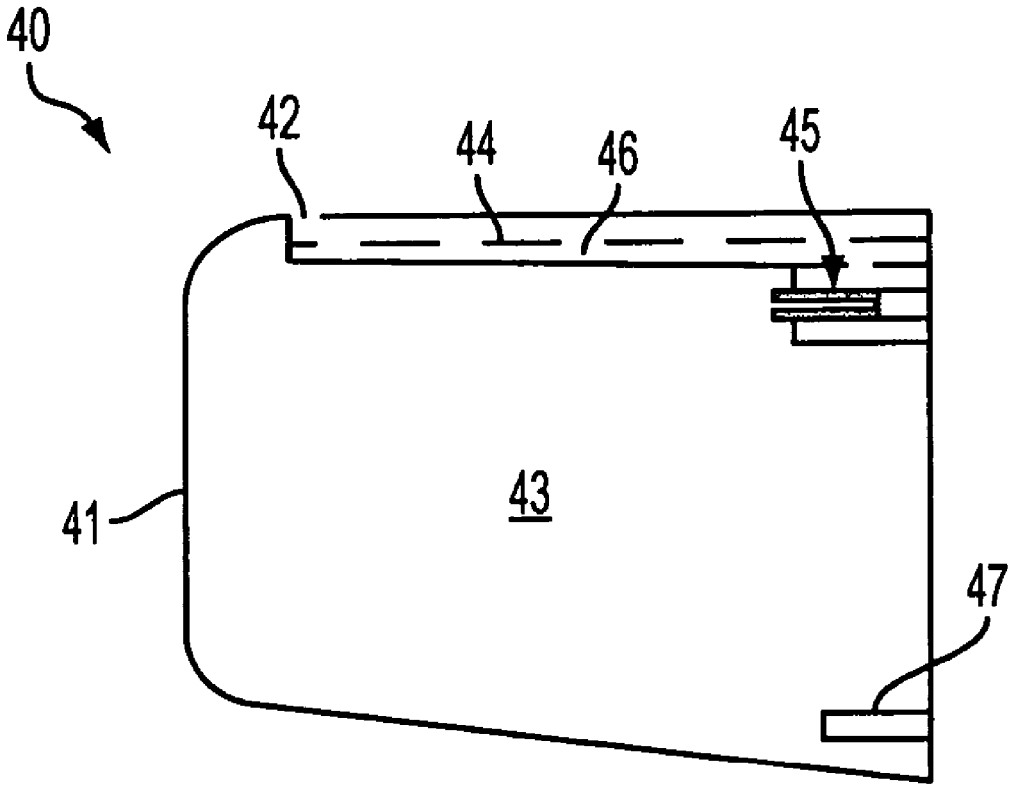
FIG. 2 is a schematic side section of an ink container for use in an ink-supply station such that that depicted in FIG. 1, and which shows a vent structure that is used to allow the interior of the ink cartridge either aspirate or vent air as is required.

FIG. 2 shows, in schematic form, a exemplary arrangement according to which a ink container 40 (which can be used as one or more/all of the ink containers 241-246, shown in FIG. 1) can be configured.

This ink container 40, in this instance, comprises, by way of example, a casing 41 which is formed with a vent 42 that is isolated from an ink storage interior 43 of the casing 41 by way of an microporous (air permeable) membrane 44 and a sealing arrangement 45. In accordance with this conceptual arrangement, the membrane 44 is disposed in a chamber 46 located atop of the casing 41. The chamber 46 is separated from the interior 43 of the casing 41 by the sealing arrangement 45. This sealing arrangement 45 is configured so that, until it is broken or opened by the disposition of the ink container 40 in an operative position on an ink supply station (e.g. ink supply station 24) and the resulting insertion of a needle, which forms part of the ink supply station, into the sealing arrangement, communication between the ink storage interior 43 of the casing 41 and the chamber 46 in which the membrane is disposed, is prevented. Thus, the membrane 44 is securely prevented from any contact with ink. This, of course, allows the ink tanks to be transported without the above-mentioned ink-membrane contact drawbacks being encountered.

Once the sealing arrangement is broken/opened, the vent 42 is configured to facilitate the input and output of ink from the container. More specifically, the vent 42 fluidically couples the interior 43 of an ink container 40 with the atmosphere to help reduce unfavorable pressure gradients that may hinder ink transport.

In order to obviate any leakage of ink following the breaking/opening of the sealing arrangement a fluidic interface (not shown in FIG. 2) can be arranged between the atmospheric side of the air permeable membrane 44 and the vent 42. An exemplary vent/fluidic interface is later described in more detail with reference to FIGS. 12-15.

An inlet/outlet port 47 is formed at the base of the casing 41. This port is controlled by a ball valve or the like which maintains the port closed until such time as a hollow ink delivery needle is inserted therein.

It should be noted that although the above ink container has been described and illustrated with reference to an off-axis ink supply, it should be understood that many of the principles herein described are applicable to on-axis ink supplies. The off-axis ink supply is provided as an example, and the application of the embodiments of the invention to on-axis ink supplies are also fully within the purview/scope of this disclosure.

Figure 4:
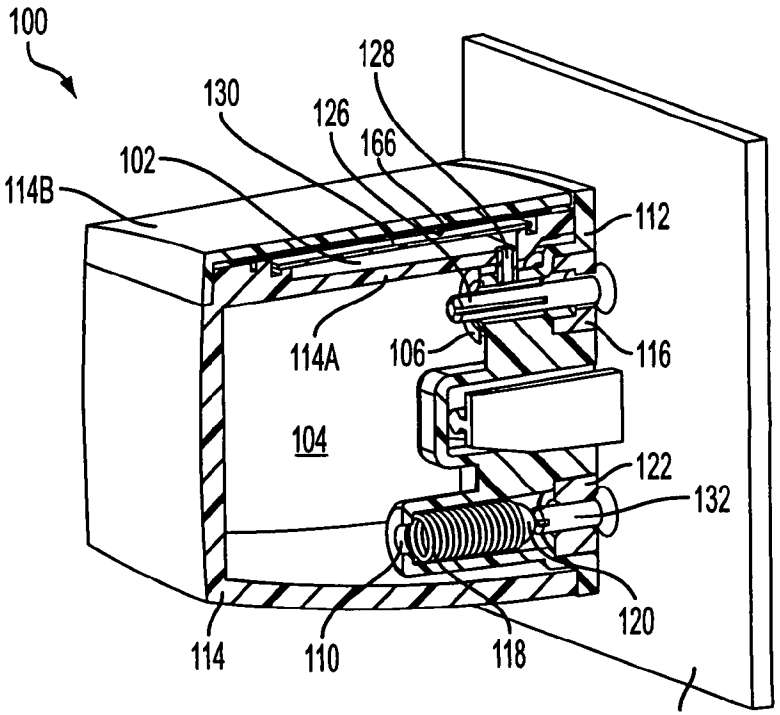
FIGS. 3 and 4 are sectioned perspective views respectively showing shipping and printer mounted conditions of a first exemplary embodiment of the invention.
Figure 3:
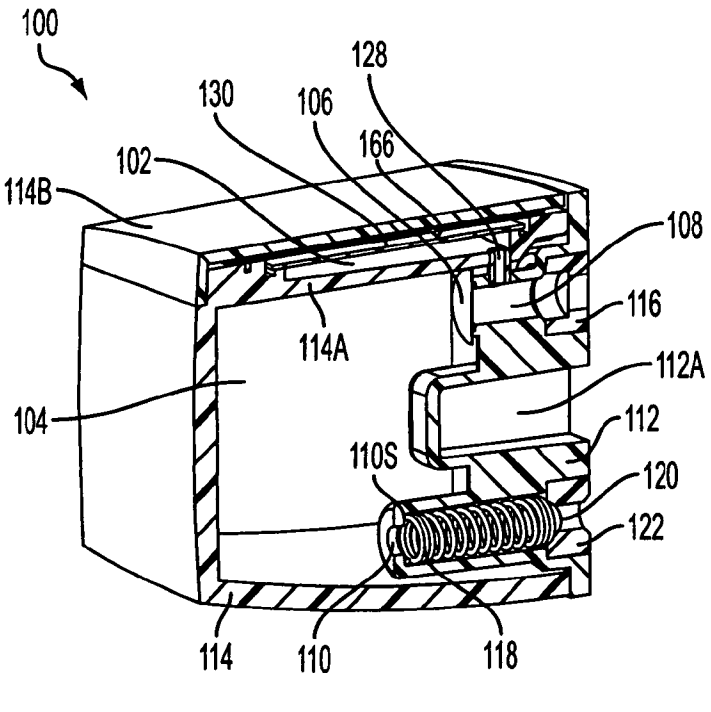
Figure 6A:
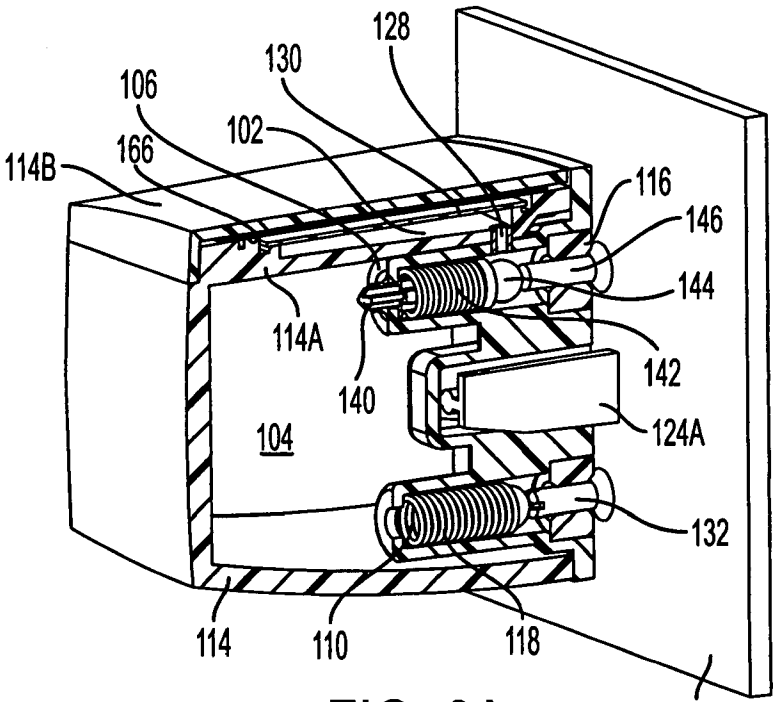

FIGS. 3 and 4 show a first exemplary embodiment in accordance with certain aspects of the invention. As shown in the sectioned perspective views, which respectively show shipping and deployed (in use) conditions, the ink container 100 according to this first embodiment is configured so that a membrane chamber 102, which is located near the top of the ink container 100, is fluidly isolated from the main ink chamber 104 by a film 106 which is staked or otherwise sealed in the illustrated position.

The film 106 is formed over the inboard mouth of a first of two through bores 108, 110 which are formed in a closure member 112 sealingly disposed in a mouth of a casing member 114 of the ink container 100. The outboard end of the first through bore 108 is closed with an elastomeric septum 116. The second through bore 110 is arranged to function as a spring chamber in which a coil spring 118 is disposed. The second through bore 110 is configured to have coil spring seat 110S at its inboard end against which the coil spring can rest. A ball valve element 120 is biased by the spring to seat on an elastomeric septum 122 which acts as a valve seat for the spherical valve element 120 (hereinafter "ball").

With this arrangement, upon the ink container 100 being mounted on a ink supply station 124, a grooved needle 126 (viz., a side broached needle) which is supported on the ink supply station 124, passes through the septum 116 and pierces the sealing film 106. This opens the upper bore 108 to the ink chamber 104 and allows communication between membrane chamber 102 and main ink chamber 104 via a connection tube or passage 128 which extends through an upper wall 114A of the casing member 114.

A membrane 130, is disposed in the membrane chamber 102 and enclosed by a gas-impermeable film 166 which is sealed to the upper wall 114A of casing member 114 and a protective cover 114B which is either snap fitted or otherwise attached to the housing 114 proper. The membrane 130 acts as ink-air separator allowing air (not ink) to pass to/from the atmosphere as ink is pumped to/from the ink container 100.

At the same time as the grooved needle 126 pieces the sealing film 106, a hollow needle 132 passes through the lower septum 122 and moves ball 120 off the valve seat formed by the septum 122. This opens the lower fluid interconnection and allows ink to flow back and forth between the ink container 100 and the ink supply station 124 through the hollow needle 132. The relative timing between 1) establishing communication from ink reservoir 104 and atmosphere via the membrane and 2) establishing the (lower) fluid interconnection to the printer are not critical as long as no fluid is pumped from the printer until both conditions are met.

In this embodiment, the upper septum 116 is configured as a slit septum. In all of the illustrated embodiments shown the lower septum 122 is configured as a septum with a ball/spring seal, however fluid communication between the printer and ink container at the lower septum could be established by other means, for example a slit septum.

The closure member 112 is provided with a guide recess 112A. In this embodiment, the guide recess 112A is formed between the through bores 108, 110 and is such as to receive a guide member 124A that is provided on the ink supply station 124 and locate the ink container 100 in a suitable position with respect to the ink supply station 124 so that the needles 126 and 132, which are respectively inserted into the through bores 108, 110, are accurately guided into position and are not damaged by any inadvertent misalignment between the ink container 100 and the ink supply station 124.

FIGS. 5 and 6A-6C show a second exemplary embodiment in accordance with certain further aspects of the invention. This embodiment is such as to use a spear 140 as an element which is used to pierce the sealing film 106 upon the ink container 100 being mounted on a printer.

This second embodiment is adapted for use with ink supply stations which are not equipped with grooved needles such as that used in the above described embodiment, and instead is arranged so that the spear 140 is disposed axially within a coil spring 142 that is used to bias a ball 144 against the partition or septum 116 which acts as the valve seat for the ball 144. Alternatively, the ball and spear could be combined into a single part retaining the required functionality of each. In this embodiment, the spear 140 has a configuration depicted in FIGS. 6B and 6C. The radial flange formed at the end of the spear 140 is dimensioned to essentially the same as the outside diameter of the spring 142 against which it abuts, and such as to be slightly less than the diameter of the bore 108 in which it is disposed. This allows sufficient clearance for air or fluid to pass thereby and thus between the membrane chamber 102 and the ink chamber 104 and vice versa.

Figure 5:
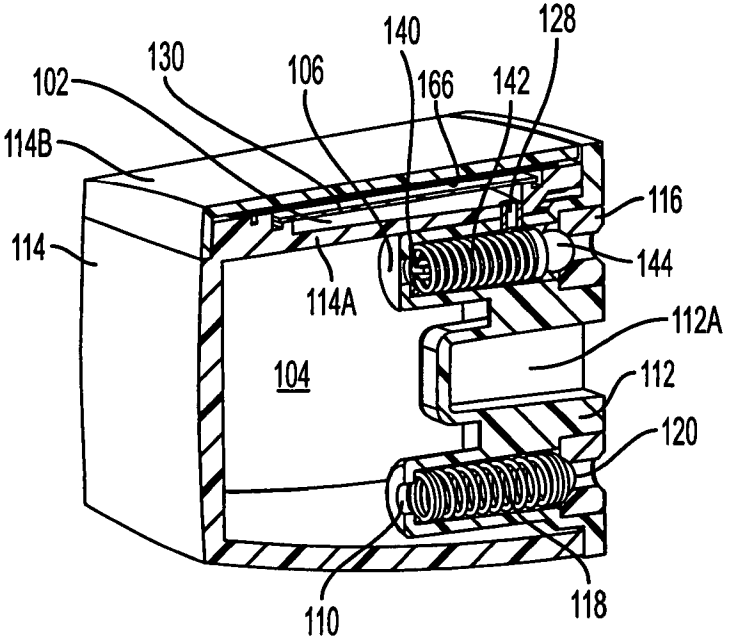
Figure 6B:
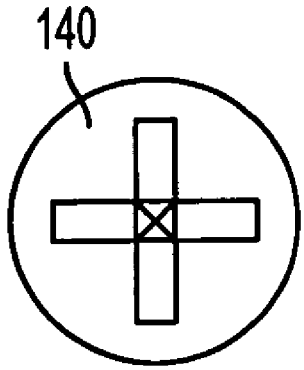
Figure 6C:
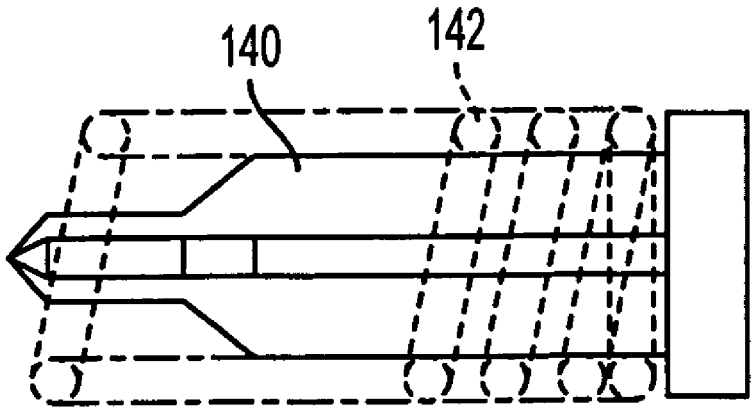

Upon an upper needle 146 engaging the ball 144 and moving it inboard of the septum 116, the spear 140 is driven by the movement of the ball 144 from the position shown in FIG. 5 to that shown in FIG. 6. Under these conditions, the sealing film 106, which is provided over the opening of the bore 108 that separates the bore 108 and the main ink chamber 104, is rent (cut or punctured) and fluid communication between the ink chamber 104 and the membrane chamber 102 via bore 108 and the connection tube or passage 128 is established.

In certain exemplary embodiments, the connection tube 128 can comprises a small bore tube which is disposed in two concentric bores formed in the closure member 112 and the casing member 114.

Figure 8:
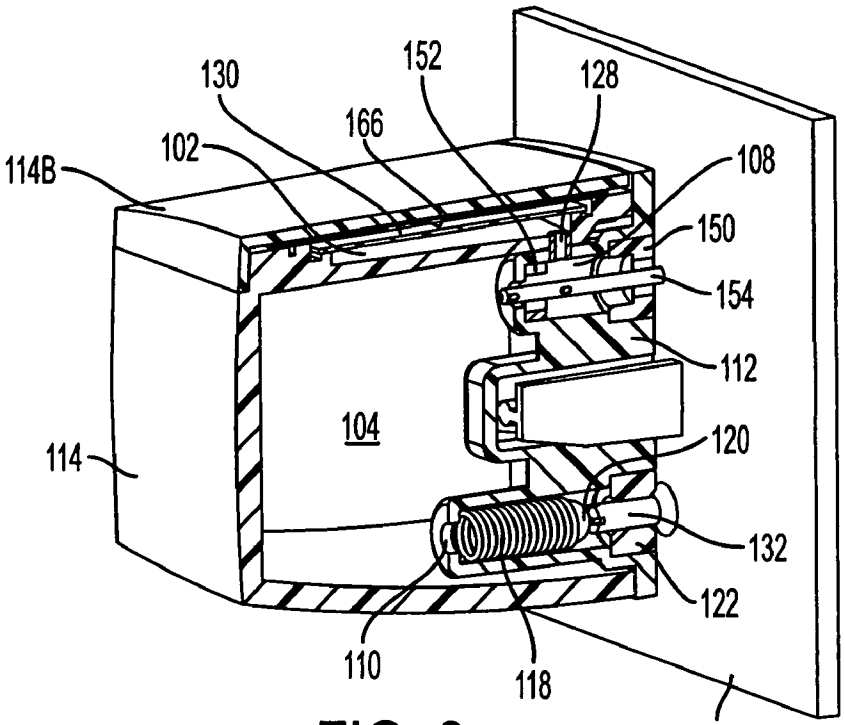
FIGS. 7 and 8 are sectioned perspective views respectively showing shipping and printer mounted conditions of a third exemplary embodiment of the invention.
Figure 7:
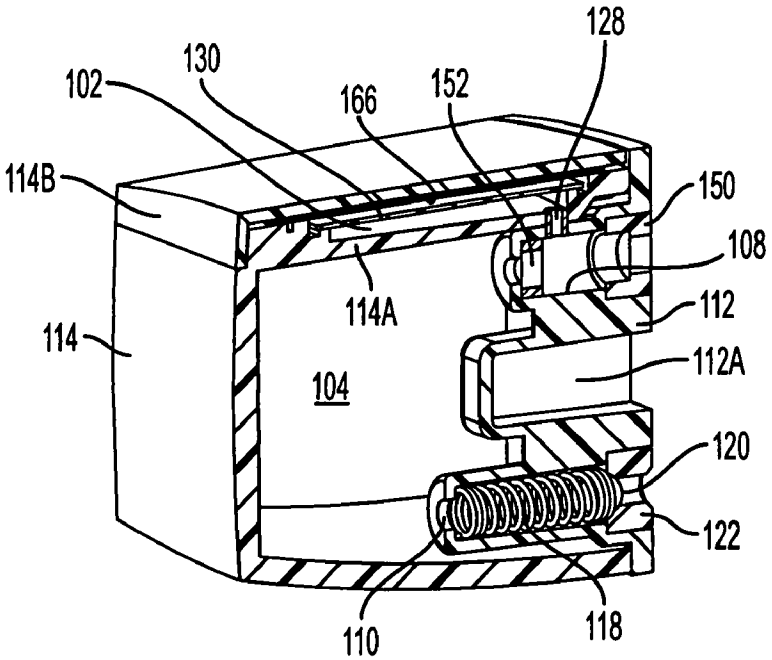

FIGS. 7 and 8 shows a third exemplary embodiment in accordance with certain further aspects of the invention. In this embodiment, the membrane chamber 102 at the top of the ink container 100 is isolated from the main ink chamber 104 by a primary slit septum 152 which is disposed in the inboard end of the upper bore 108, while a secondary slit septum 150 which is disposed at the outboard end of the bore 108, seals in ink during/after use in the printer.

Upon insertion of the ink container 100 into the ink supply station, an elongate needle 154 that is mounted on the printer, passes through both septa 150 and 152. The construction of the needle allows for an air- and liquid-tight seal (e.g. a radial seal) with septa 150 while providing an air/liquid path through septa 152. In this instance, the needle 154 is hollow but blind on both ends. The sides of the needle is broached providing holes/openings that located on either side of the inboard septum 152 allowing communication between membrane chamber 102 and main ink chamber 104 via the interior of the needle 154, the bore 108 and the connection tube 128. Alternatively, the needle can be a solid-core design with radial ribs only in the vicinity of septa 152 allowing air/liquid communication past septa 152 along the valleys between the ribs in a manner similar to needle 126 shown in FIG. 4. As in the previous embodiments, the membrane 130 acts as ink-air separator allowing air (not ink) to pass to/from atmosphere as ink in pumped to/from the ink container 100.

At the same time that the elongate needle 154 passes through the two septa 150 and 152 which are disposed at the opposite ends of the upper bore 108, needle 132 displaces ball 120 away from septum 122. As in previous embodiments, this allows ink to flow back and forth to the printer via the hollow needle 132.

Figure 10:
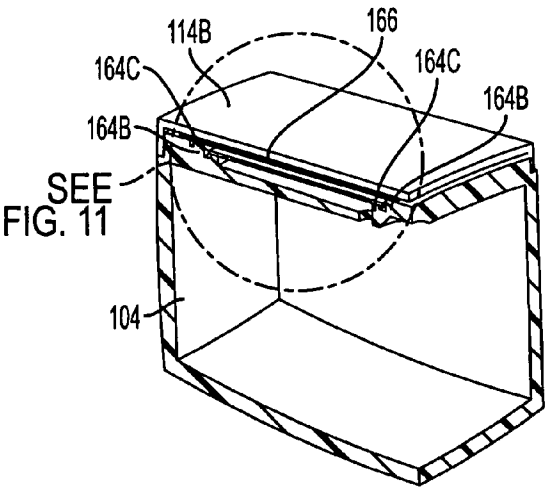
FIG. 10 is a sectioned view showing features of the exemplary membrane and exemplary cover arrangement.
Figure 9:
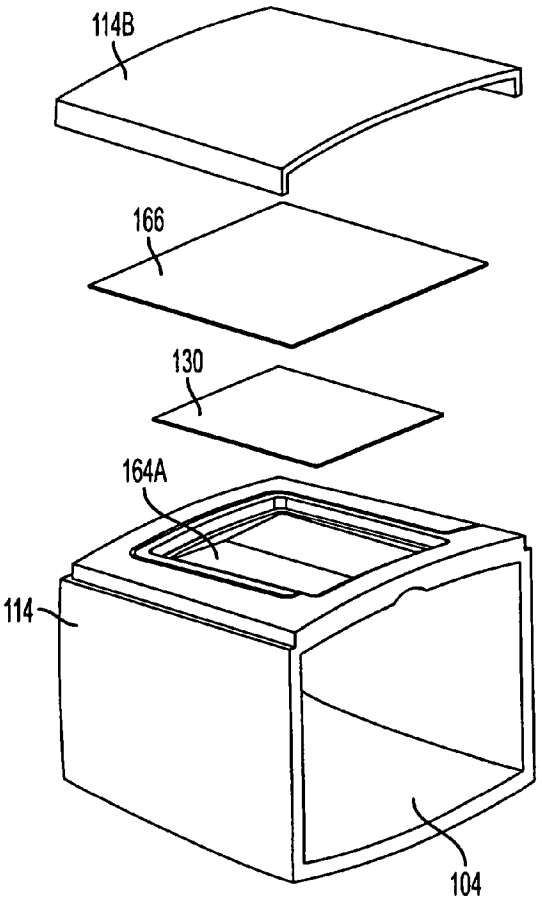
FIG. 9 is an exploded perspective view showing one arrangement via which a membrane and cover structure may be disposed in the preceding and/or other exemplary embodiments of the invention.

FIG. 9 shows a construction which can be used to form the exemplary membrane chamber 102 on an external surface of casing member 114 which defines the main ink chamber 104. As shown in exploded form in FIG. 9, and illustrated in FIGS. 10-11, a multi-layer arrangement is secured in position on top of the main casing member and then enclosed by the protective cover 114B that is secured in position either by snap connection, spot welding or the like. In this example, membrane chamber 102 provides a wet side volume exposed to ink/air and a dry side volume exposed to atmosphere via a labyrinth channel.

In more detail, the exemplary structure which is shown in FIG. 9 is such that a recess 164A (V-shaped in this embodiment) is formed in the casing member 114 within which is located the upper opening of communication tube 128. Also within this recess 164A is a raised rib 164B that follows the perimeter of the recess and which forms an attachment surface for membrane 130. The area bounded by the inner rib 164C is sized to provide enough surface area on the wet side of the membrane 130 to allow an adequate ink/air separation rate based on permeability properties of the membrane, wetting characteristics of the ink, and the operating characteristics of the pumping system. Additionally within the region bounded by inner rib 164C the surfaces are sloped towards connector tube 128 to allow any liquid ink which has been pumped into or has coalesced from the air/ink froth in the wet side of the membrane chamber to drain back into the ink reservoir via connection tube 128. Membrane 130 can be heat-staked, glued or otherwise affixed to the top surface of the inner rib 164C (see FIG. 11) sealing it to the casing member 114 along the perimeter of the membrane 130 and the rib 164C and covering the point where the communication tube 128 opens through the top of the casing member 114 (see FIG. 8). This completes the wet side volume of the exemplary membrane chamber 102.

Figure 11:
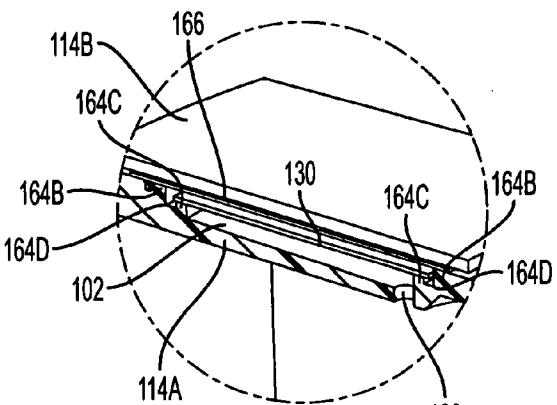
FIG. 11 is an enlarged view of the exemplary portion of the FIG. 10 which is enclosed in the phantom circle.
Figure 13:
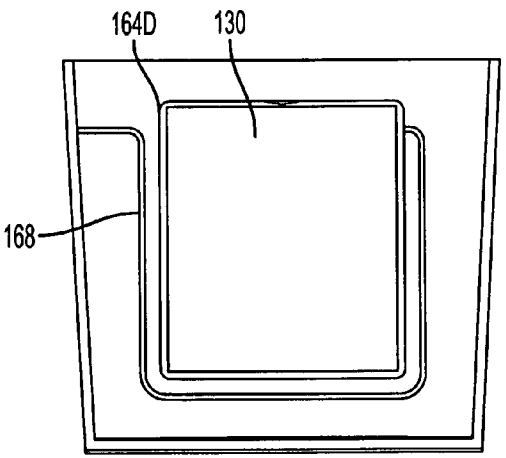
Figure 14:
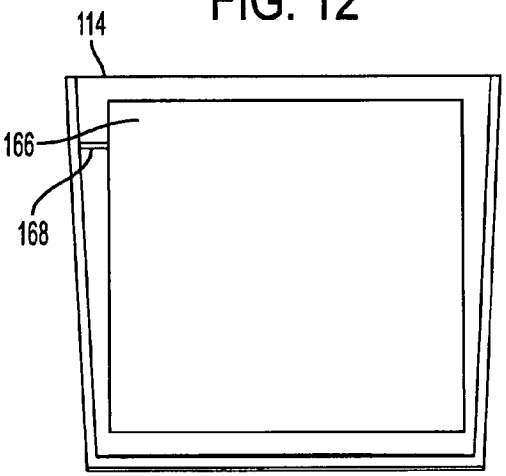
Figure 15:
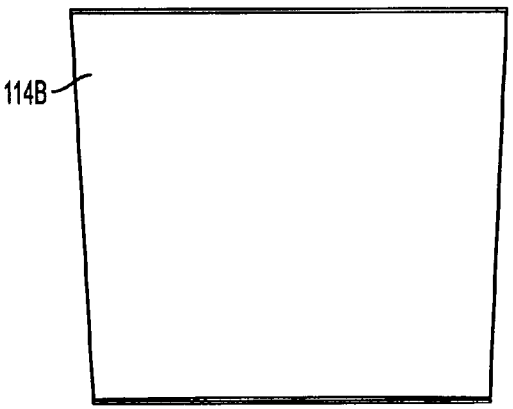

To complete the dry side volume of the exemplary membrane chamber 102, the recess 146A is then covered with a gas impermeable film 166 which also extends over a labyrinth channel 164D (see FIGS. 11, 13 and 14). The film 166 is attached/secured in place providing a seal between the casing 114 and film 166 along the perimeter of rectangular recess 164A of the casing member and along the edges of a labyrinth channel 168.

Figure 12:
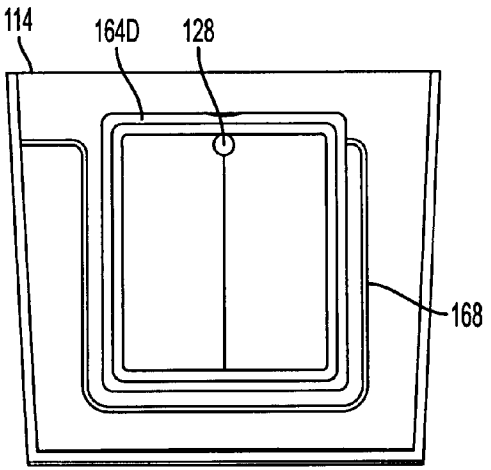
FIGS. 12-15 show the manner in which the exemplary elements shown in FIG. 7, may be arranged/assembled with respect to one another.

Thus, the labyrinth channel 168 communicates with the rectangular dry volume of the membrane chamber and leads to one side of the casing member in the manner shown in FIGS. 12-14, and is covered by a side extending portion of the film 166. This completes the membrane chamber 102 and a labyrinth path which is associated therewith. The labyrinth channel 168 is sized in cross section and length to maintain a relative humidity gradient which is near 100% at its membrane end and at current atmospheric conditions at the end open to atmosphere while providing adequate airflow during printing system pump operations. In normal operation this keeps ink from drying out and clogging the membrane 130. In the case of a membrane failure the labyrinth path also provides a pre-directed leak path for any leaking ink. The protective cover 114B is then disposed over the membrane chamber 102 which, in this instance is in effect, defined by the film 166 which is fixed to the upper surface 114A of the casing member 114. The protective cover 114B shown in FIGS. 3-11 and 15 may be optional if the material for the gas impermeable film 166 is chosen to be sufficiently robust to damage during normal operation and handling.

The gas impermeable film 166 which is used in this embodiment, can be made of any suitable material and may be heat staked in position, secured using a PSA (pressure sensitive adhesive) label technique, or a number of other suitable methods. Other gas-permeable structures (e.g. metal coated molded plastic) may be substituted for the film.

While the invention has been described with only reference to a limited number of exemplary embodiments, it will be understood that a person skilled in the art to which the present invention pertains or most closely pertains, would be able to envisage and make various changes and modifications without departing from the scope of the present invention which is limited only by the appended claims.

For example, while the communication between the ink chamber 104 and the membrane chamber 102 has been disclosed as including a connection tube or passage 128, a tube per se is not necessary and this communication can be constituted simply by two through holes which are respectively formed in the upper wall 114A of casing member, and in the closure member 112, and which become essentially aligned when the closure member 112 is inserted into position in the casing member 114 so long as the resulting communication path is sealed so as to be air tight.

What is claimed is:

1. An ink container comprising:

a first chamber configured to contain ink;

a second chamber enclosing an ink-air separating membrane through which air but not ink may pass;

an opening between the first chamber and the second chamber;

a breachable seal closing and sealing the opening; and first and second bores into the first chamber which are respectively configured to receive first and second needles from a printer ink supply station on which the ink container is configured to be disposed, the first bore forming a part of the opening between the first chamber and the second chamber and the breachable seal disposed in the first bore such that the first needle breaches the seal when inserted fully into the first bore.

2. An ink container as set forth in claim 1, wherein the first and second bores respectively have first and second septa disposed in outboard ends thereof.

3. An ink container as set forth in claim 2, wherein at least one septum of the first and second septa comprises a valve seat for a ball valve element which is biased thereagainst by a spring disposed in the bore corresponding to the at least one septum.

4. An ink container as set forth in claim 2, wherein the breachable seal comprises a third septum disposed at an inboard end of the first bore.

5. An ink container as set forth in claim 4, wherein the first and third septa are arranged so that a needle may pass through both and extend beyond the third septum into the first chamber.

6. An ink container as set forth in claim 5, wherein the needle is hollow and has side broached openings to allow communication from the first chamber into the first bore via the hollow of the needle.

7. An ink container as set forth in claim 1, wherein the breachable seal comprises a sealing film disposed over an inboard end of the first bore.

8. An ink container comprising:

a first chamber configured to contain ink;

a second chamber enclosing an ink-air separating membrane through which air but not ink may pass;

an opening between the first chamber and the second chamber;

a breachable seal closing and sealing the opening; and a bore into the first chamber, the bore forming a part of the opening between the first chamber and the second chamber and the bore having an inboard end and an outboard end, the outboard end being closed by a first septum and the inboard end being closed by the breachable seal.

9. An ink container as set forth in claim 8, wherein the breachable seal comprises a film configured to be rent by an elongate member when the ink container is mounted on a printer.

10. An ink container as set forth in claim 8, wherein the breachable seal comprises a second septum configured to permit an elongate member to pass sealingly therethrough when the ink container is mounted on a printer.

11. An ink container as set forth in claim 10, wherein the elongate member is configured to allow ink from the first chamber to pass into the bore after the elongate member passes through the second septum.

12. An ink container as set forth in claim 9, wherein the elongate member is configured to allow ink from the first chamber to pass into the bore after the elongate member passes through the film.

13. An ink container as set forth in claim 9, wherein the elongate member comprises a spear in the bore spring biased toward the outboard end of the bore.

14. An ink container as set forth in claim 13, wherein a valve is disposed between the spear and the septum, the valve being normally driven against the septum by the spring bias applied to the spear.

15. An ink container as set forth in claim 14, wherein the valve is configured to be driven toward the inboard end of the bore when the ink container is mounted on a printer and a needle on the printer passes through the septum and engages the valve.

16. An ink container comprising:

a first chamber configured to contain ink;

a second chamber enclosing an ink-air separating membrane through which air but not ink may pass;

an opening between the first chamber and the second chamber;

a breachable seal closing and sealing the opening; and the ink-air separating membrane is suspended in the second chamber such that a wet side portion of the membrane is exposed to the opening and a dry side portion opposite the wet side portion is not exposed to the opening.

* * * * *